US008261466B2

(12) United States Patent
Latack et al.

(10) Patent No.: US 8,261,466 B2
(45) Date of Patent: Sep. 11, 2012

(54) CLOTHES DRYER DRIVE AND BLOWER SYSTEM

(75) Inventors: Thomas A. Latack, Baroda, MI (US); James P. Carow, Saint Joseph, MI (US); Christopher A. Jones, Benton Harbor, MI (US); William L. Frantz, Berrien Springs, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 818 days.

(21) Appl. No.: 12/424,602

(22) Filed: Apr. 16, 2009

(65) Prior Publication Data

US 2009/0193678 A1 Aug. 6, 2009

Related U.S. Application Data

(63) Continuation of application No. 11/033,681, filed on Jan. 12, 2005, now abandoned.

(51) Int. Cl.
*F26B 11/02* (2006.01)

(52) U.S. Cl. ..... 34/601; 34/607; 68/15; 68/20; 8/159

(58) Field of Classification Search ..... 34/90, 130, 34/138, 139, 601, 606, 607, 201; 8/159; 68/15, 20

See application file for complete search history.

(56) References Cited

U.S. PATENT DOCUMENTS

| | | | | | |
|---|---|---|---|---|---|
| 2,361,297 | A | * | 10/1944 | Kutsche | 34/79 |
| 2,688,806 | A | * | 9/1954 | Long | 34/75 |
| 2,752,694 | A | * | 7/1956 | McCormick | 34/60 |
| 2,803,142 | A | * | 8/1957 | Kauffman, II | 476/67 |
| 3,831,292 | A | * | 8/1974 | DePas | 34/75 |
| 3,858,330 | A | * | 1/1975 | De Pas | 34/75 |
| 4,360,977 | A | * | 11/1982 | Frohbieter | 34/86 |
| 4,516,331 | A | * | 5/1985 | Yamauchi et al. | 34/77 |
| 5,127,169 | A | * | 7/1992 | Ellingson | 34/601 |
| 5,555,647 | A | * | 9/1996 | Torborg et al. | 34/601 |
| 6,154,978 | A | * | 12/2000 | Slutsky | 34/321 |
| 7,020,985 | B2 | * | 4/2006 | Casey et al. | 34/595 |
| 2004/0055176 | A1 | * | 3/2004 | Yang et al. | 34/549 |
| 2006/0150439 | A1 | * | 7/2006 | Latack et al. | 34/601 |

FOREIGN PATENT DOCUMENTS

GB 2361297 A * 10/2001

* cited by examiner

*Primary Examiner* — Stephen M. Gravini
(74) *Attorney, Agent, or Firm* — Clifton G. Green; McGarry Bair PC

(57) ABSTRACT

An automatic clothes dryer having separately driven drum and blower.

28 Claims, 11 Drawing Sheets

CLOTHES DRYER DRIVE AND BLOWER SYSTEM

CROSS-REFERENCE TO RELATED APPLICATION

This application is a continuation of U.S. patent application Ser. No. 11/033,681, filed Jan. 12, 2005, which is incorporated herein by reference in its entirety.

BACKGROUND OF THE INVENTION

1. Field of the Invention

The invention relates generally to automatic clothes dryers having separately driven drum and blower 2. Description of the Related Art Automatic clothes dryers are well known, and typically comprise, a cabinet enclosing a horizontally rotating drum for holding items to be dried and accessible through an access door at the front of the cabinet. The drum is rotated by a belt which is driven by a motor. The motor also drives a blower assembly which delivers dry, heated or unheated air to the drum for drying the items, and exhausts humid air from the drum to a discharge location exterior of the cabinet. The motor and blower assembly are typically mounted in a lower portion of the cabinet beneath the drum. The drum has a first diameter which is ideally maximized within the dimensions of the dryer cabinet. The blower assembly typically utilizes a horizontally rotating fan, having a second, smaller diameter, which must fit within the remaining dryer cabinet space not occupied by the drum. This frequently limits either the size of the drum or the size of the fan, or both.

Dryer cabinets are typically dimensioned to occupy a predetermined sized space, height, width, and depth, in a laundry room or basement area. This simplifies the construction of laundry rooms and any cabinetry. However, a preselected dimension necessarily limits the cabinet interior space available for enclosing the drum, the motor, and the blower assembly. This is a disadvantage in that there is a growing demand for larger capacity dryers.

The capacity of a conventional dryer is further limited in that conventional dryers use a single-shaft, dual-drive motor for driving both the drum and the blower. One end of the shaft is provided with a pulley for driving the belt rotating the drum. The other end of the shaft is directly coupled to the shaft of the blower impeller. The combined mounting of the drum drive and the blower limits where the motor can be mounted within the cabinet as the drum drive needs to be located such that the belt can connect to the drum, with the result that the motor is often located in such a position that the diameter of the drum cannot be maximized within the cabinet in order to accommodate the motor, drum drive, and blower housing.

The coupling of the blower impeller directly to the motor shaft while mechanically convenient is disadvantageous in that it requires the air flow path through the dryer to have additional paths or bends, which slow down the air flow and increase the back pressure in the system. Specifically, the longitudinal axis of the blower is oriented either coaxially or in parallel with the longitudinal axis of the motor. This configuration requires a relatively large space for the blower and motor. This also typically results in a blower exhaust opening which is oriented 90° to the dryer exhaust vent, thereby requiring a 90° elbow between the blower exhaust opening and the dryer exhaust vent.

There is an increasing need in the household dryer market for a dryer with a larger drum capacity for drying larger loads, thereby minimizing the number of separate loads that must be dried, and drying heavy, bulky items such as comforters, rugs, and the like. This need continues to increase as washers are able to achieve larger capacities. Conventional dryer configurations have reached their capacity limits. A new dryer configuration is needed.

SUMMARY OF THE INVENTION

In one embodiment, an automatic clothes dryer comprises a cabinet defining an interior space and having an opposing top and bottom and opposing sides extending between the top and bottom to partially define the interior space and to form corners at the junction of the top and bottom with the sides, a cylindrical drum defining a drying chamber and rotatably mounted within the interior space to define subspaces within the interior space between the corners and the drum, a drive motor mounted within one of the subspaces and having an output shaft operably coupled to the drum for rotating the drum, and a blower mounted within the interior space out of the subspaces and between the drum and one of the bottom and top, and fluidly coupled to the drying chamber for moving air through the drying chamber, the blower having a drive shaft separate and remote from the output shaft to permit the independent positioning of the blower and drive motor.

In another embodiment, an automatic clothes dryer comprises a cabinet defining an interior space. A drum is rotatably mounted within the interior space and defines a drying chamber. A drive motor is mounted within the interior space and has an output shaft operably coupled to the drum for rotating the drum. A blower is mounted within the interior space and is fluidly coupled to the drying chamber for moving air through the drying chamber. The blower has a drive shaft rotatable about a blower axis that is separate and orthogonal to the drum axis, and the direction of air flow exhausted from the blower is substantially parallel to the drum axis.

DESCRIPTION OF AN EMBODIMENT OF THE INVENTION

Figure 1:
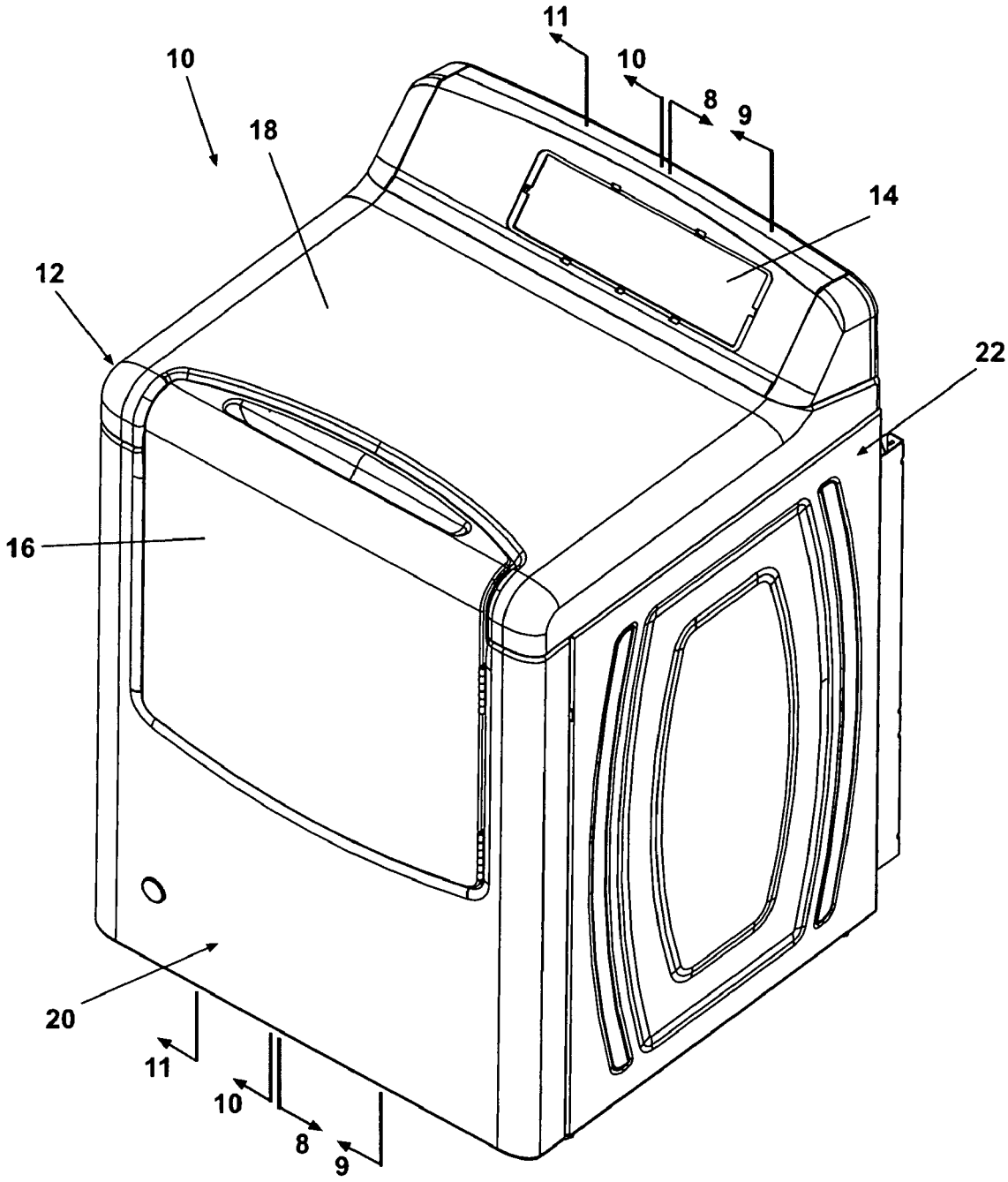
FIG. 1 is a perspective view of an automatic clothes dryer comprising a cabinet enclosing a rotating drum and an axial flow drive and blower assembly according to the invention.
Figure 2:
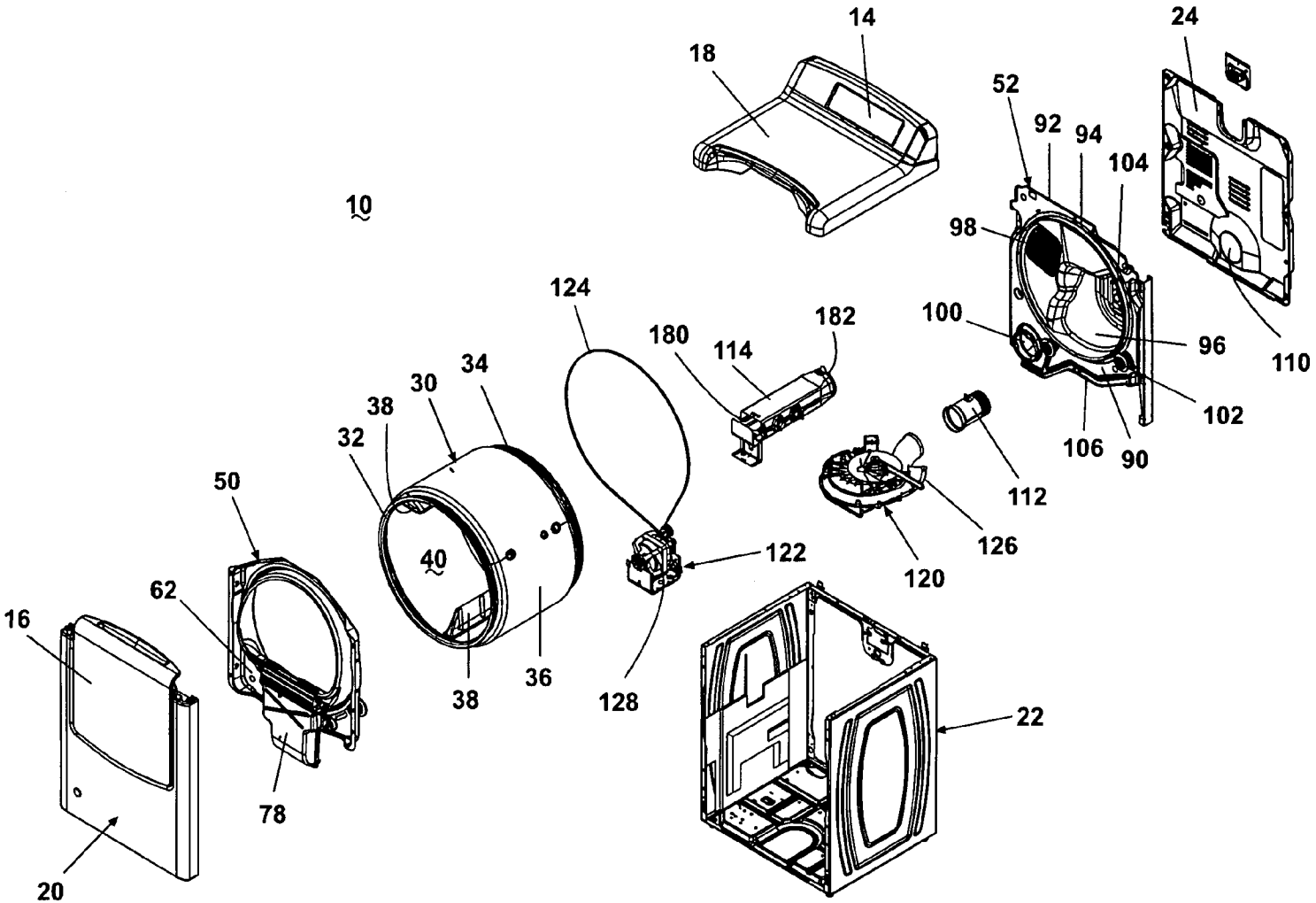
FIG. 2 is an exploded view of the automatic clothes dryer illustrated in FIG. 1 showing the axial flow drive and blower assembly according to the invention.

Referring to the Figures, and in particular to FIGS. 1 and 2, an embodiment of an automatic clothes dryer 10 according to the invention is illustrated comprising a cabinet 12 having a control panel 14 for controlling the operation of the dryer 10, a door 16 hingedly attached to a front wall 20, and a chassis 22, which supports a top wall 18, the front wall 20, and a rear wall 24. The clothes dryer 10 described herein shares many features of a well-known clothes dryer, and which will not be described in detail except as necessary for a complete understanding of the invention. In particular, the automatic clothes dryer industry has developed a standardized size for an automatic clothes dryer which enables a residential laundry space to be dimensioned to accommodate a standard sized automatic clothes dryer, thereby eliminating the time and expense of customizing the laundry space to accommodate a selected dryer. The embodiment of the automatic clothes dryer 10 described herein preferably comprises a cabinet 12 having standardized dimensions. The standard dimensions may be either a standard height or a standard width. Preferably, the standard height is no more than 38 inches and the standard width is no more than 29 inches.

Referring to FIGS. 2-5, the cabinet 12 encloses a rotating drum 30, a centrifugal blower assembly 120, and a motor assembly 122. The drum 30 is rotatably supported between a front drum panel 50 and a rear drum panel 52. The front drum panel 50 is located intermediate the drum 30 and the front wall 20, and is preferably fabricated of stamped sheet metal. The rear drum panel 52 is located intermediate the drum 30 and the rear wall 24, and is preferably fabricated of stamped sheet metal.

The front drum panel 50 is a somewhat irregularly-shaped panel comprising an inner face 60 and an opposed outer face 62. The front drum panel 50 is provided therethrough with a somewhat conduit-like access wall 64 terminating at a first end in a D-shaped access lip 66 defining a D-shaped access opening 68, and at a second end in a raised, circular drum flange 70 extending away from the inner face 60. The access lip 66 is adapted in a well-known manner for sealable closure of the door 16 over the access opening 68. The drum flange 70 is adapted in a well-known manner for cooperative registry with the drum 30 and is rotatable mounted on drum rollers 82.

Figure 3:
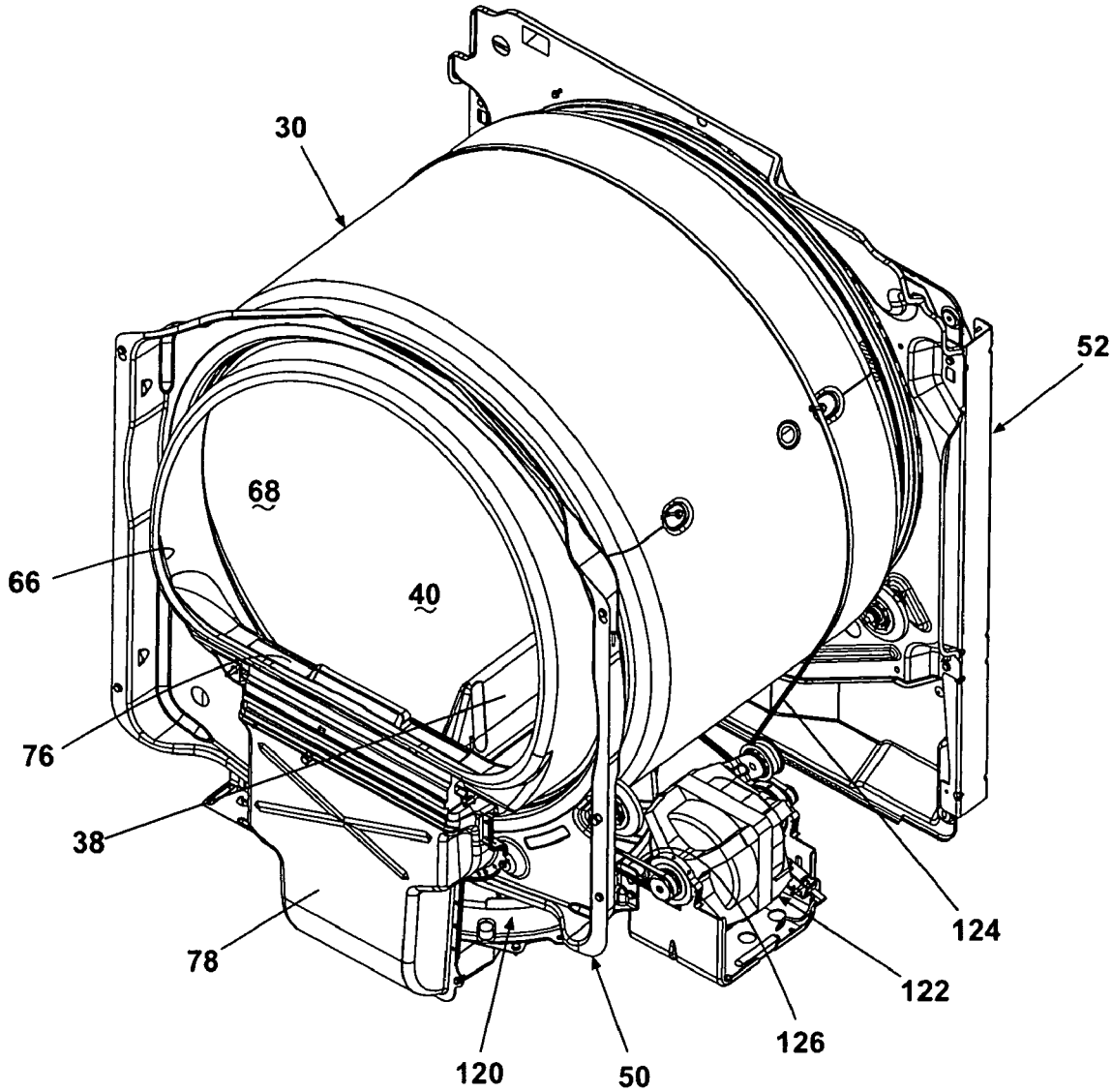
FIG. 3 is a perspective view of the automatic clothes dryer illustrated in FIG. 1 with the cabinet removed for clarity.

Extending along a bottom portion of the access wall 64 adjacent the access opening 68 is an air circulation enclosure 72 having a grille 74 therethrough. An upper portion of the enclosure 72 is provided with a suitable slot (not shown) for receipt of a well-known removable lint screen 76 (FIG. 3). The air circulation enclosure 72 transitions to an air circulation duct 78 extending away from the front drum panel 50 to terminate in an exhaust opening 80. The air circulation duct 78 comprises a well-known hollow duct work fluidly connected with the air circulation enclosure 72 to direct the flow of air through the grille 74 and into the air circulation enclosure 72, to exit through the exhaust opening 80. The air circulation duct 78 can comprise separate front and rear pieces which are assembled to the front drum panel 50, or can be integrally formed with the front drum panel 50.

The drum 30 comprises a generally hollow, cylindrical drum body 36, having a diameter, terminating at one end in a circular front sealing flange 32 and at a second, opposed end in a circular rear sealing flange 34, and defining a drying chamber 40. The drum body 36 is provided with a plurality of irregularly-spaced, radially-inwardly directed paddles (also known as "baffles") 38 extending into the drying chamber 40 for agitation of items placed in the dryer 10 for drying as the drum 30 is rotated.

Figure 4:
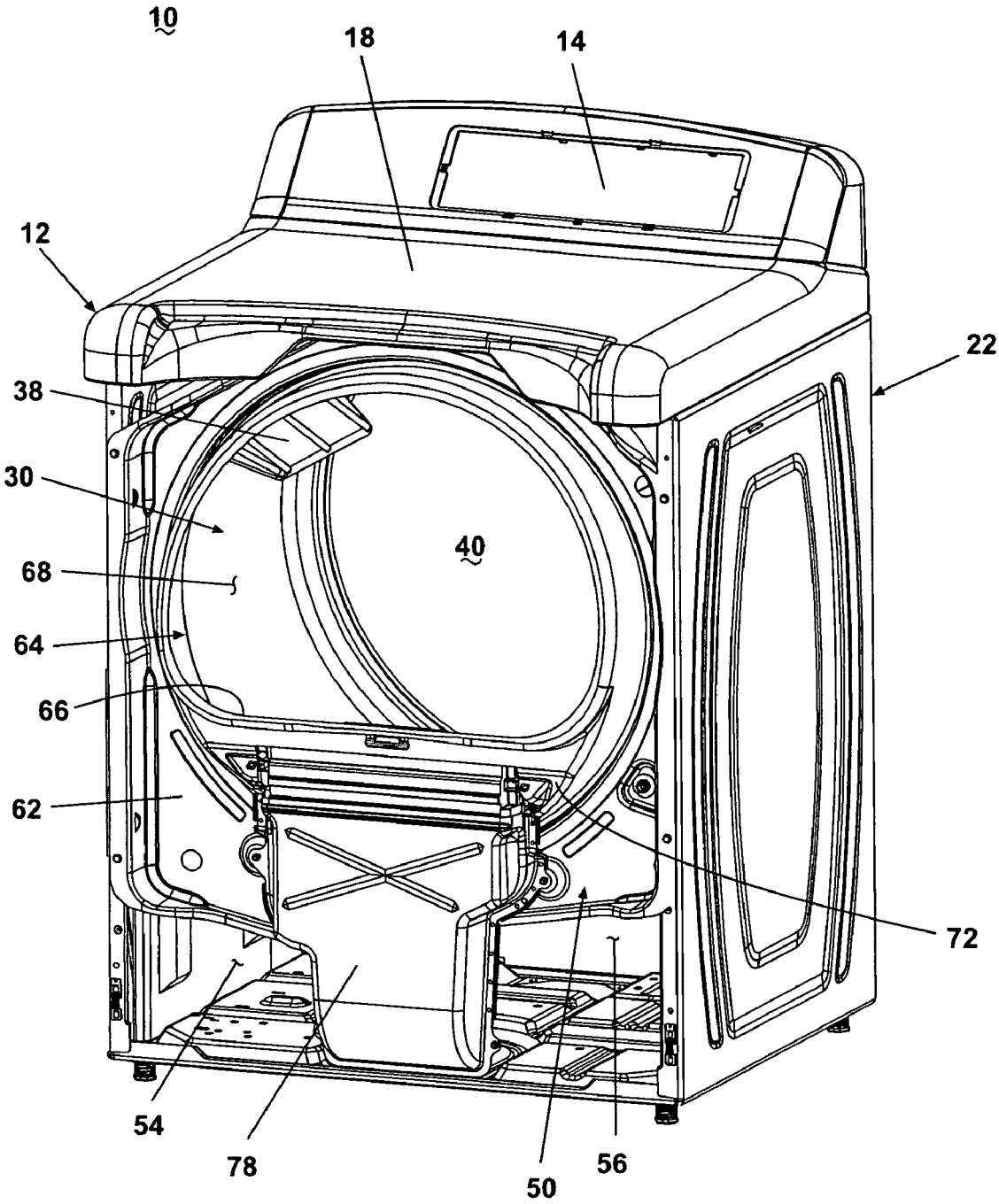
FIG. 4 is a perspective view of a portion of the automatic clothes dryer illustrated in FIG. 1 comprising a front drum panel having an access opening and an air exhaust duct for exhausting air from the drying chamber, with the cabinet front removed for clarity.
Figure 5:
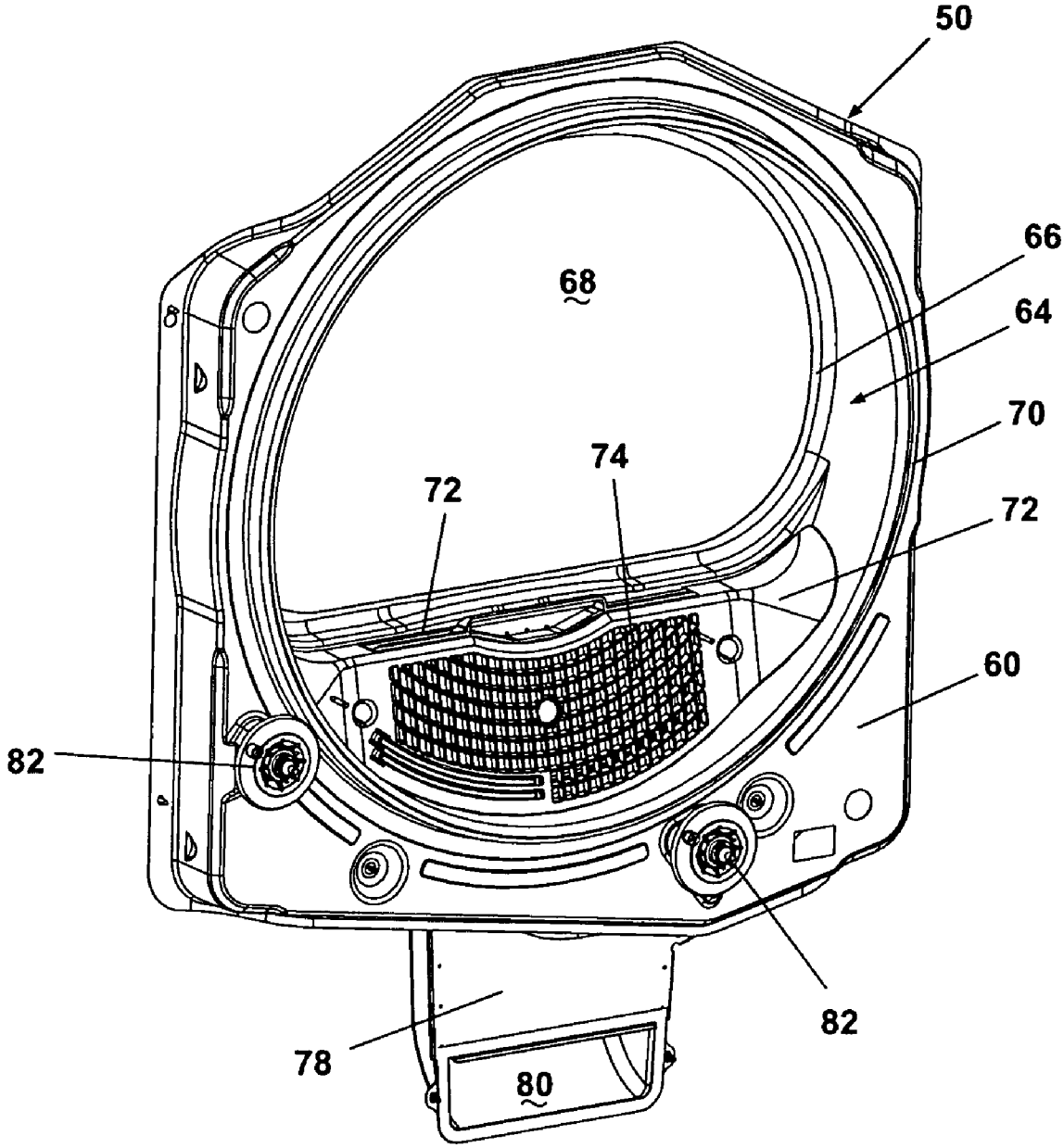
FIG. 5 is a perspective view of a portion of the inside of the front drum panel illustrating the inlet opening to the exhaust duct and in which the lint filter is located, the remainder of the dryer being removed for clarity.

The drum 30 is supported within an upper portion of the cabinet 12 to rotate about a horizontal axis. Beneath the drum 30, the cabinet 12 defines an interior space comprising a left subspace 54 and a right subspace 56 when viewed from the front of the dryer 10 (FIG. 4).

Figure 8:
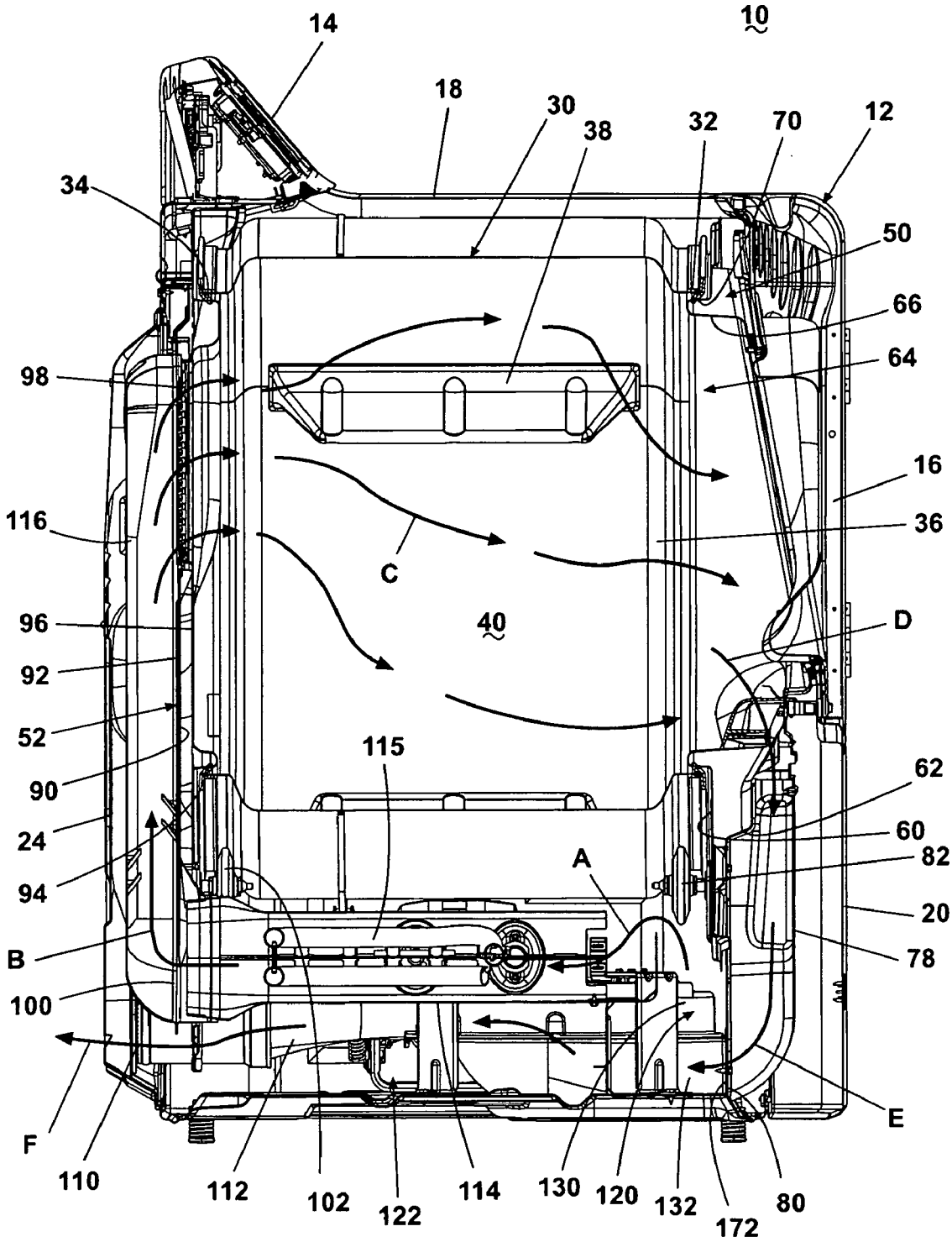
FIG. 8 is a sectional view of the automatic clothes dryer of FIG. 1 taken through view line 8-8, illustrating air flow through the clothes dryer.

Referring to FIGS. 3 and 8, the front sealing flange 32 is adapted for slidable registry with the drum flange 70, preferably by insertion of the front sealing flange 32 coaxially into the drum flange 70. A well-known ring-like gasket (not shown) can be retained between the front sealing flange 32 and the drum flange 70 to improved air tightness, reduce vibration and noise, and facilitate slidable rotation of the front sealing flange 32 in the drum flange 70.

Referring now to FIGS. 2 and 8, the rear drum panel 52 is a somewhat irregularly-shaped panel comprising an inner face 90 and an opposed outer face 92. A raised, circular drum flange 94 extends away from the inner face 90 and circumscribes an end panel 96 having a grille 98 extending therethrough at an upper portion thereof. The drum flange 94 is adapted for slidable registry with the rear sealing flange 34 of the drum 30, preferably by insertion of the rear sealing flange 34 coaxially into the drum flange 94. A well-known ring-like gasket (not shown) can be retained between the rear sealing flange 34 and the drum flange 94 to improve air tightness, reduce vibration and noise, and facilitate slidable rotation of the rear sealing flange 34 in the drum flange 94. As illustrated in FIG. 3, the front drum panel 50 and the rear drum panel 52 are positioned relative to each other so that the centers of the drum flanges 70, 94 are in horizontal coaxial alignment for rotation of the drum 30 about a horizontal axis.

An air inlet port 100 is provided in the rear drum panel 52 at a lower portion thereof adjacent the drum flange 94. A vertical air conduit 116 extends along the outer face 92 for fluid communication of the air inlet port 100 with the grille 98 to direct the flow of air through the inlet port 100 to exit the grille 98.

Figure 11:
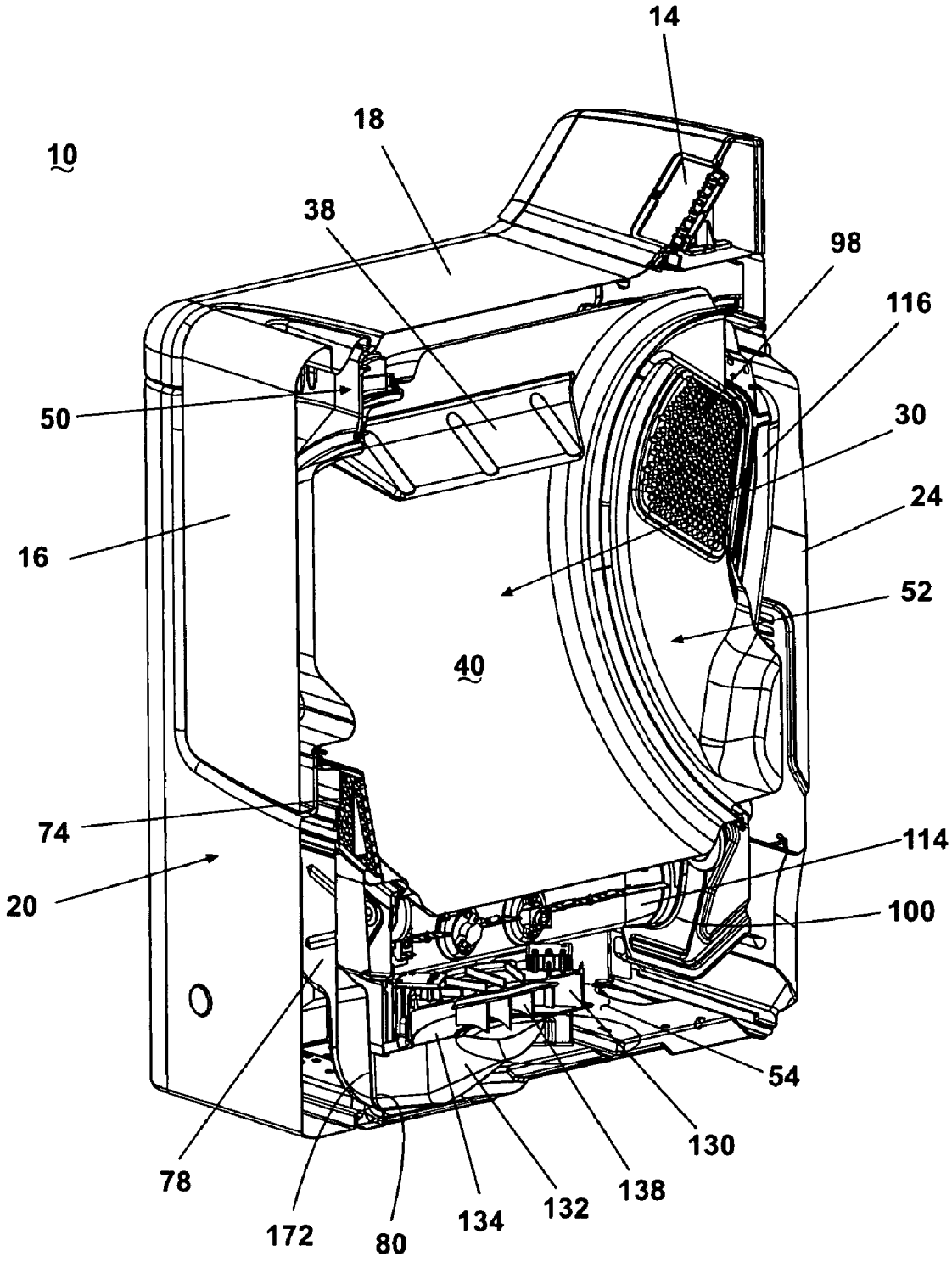
FIG. 11 is a sectional view of the automatic clothes dryer of FIG. 1 taken through view line 11-11.

As illustrated in FIGS. 2, 3 and 8, the drum 30 is supported in an upper portion of the cabinet 12 above the interior space 26 comprising the left subspace 54 and the right subspace 56. The interior space is adapted for receipt of a centrifugal blower assembly 120, a motor assembly 122, and an inlet air conduit 114, which are fixedly attached in a well-known manner to the chassis 22. The inlet air conduit 114 comprises an elongated, hollow body mounted in the left subspace 54, and terminating at a first end in an air inlet 180 and at an opposed second end in an air outlet 182. The inlet air conduit 114 can be provided with a well-known heating element 115 for heating air prior to introduction of the air into the drying chamber 40. As illustrated also in FIG. 11, the inlet air conduit 114 is fluidly connected to the air inlet port 100 to supply air through the vertical air conduit 116 and the grille 98 into the drying chamber 40.

The motor assembly 122 comprises a well-known electric motor 128 mounted in a suitable bracket for fixedly attaching the motor assembly 122 to the chassis 22. The motor 128 is adapted in a well-known manner with an output shaft for driving a drum drive belt 124 at a first end, and for driving a blower drive belt 126 at a second end. The drum drive belt 124 encircles the drum 30 for rotation of the drum 30 with rotation of the motor 128. The blower drive belt 126 is operably connected to the blower assembly 120 for operation of the blower assembly 120 with rotation of the motor 128.

Figure 6:
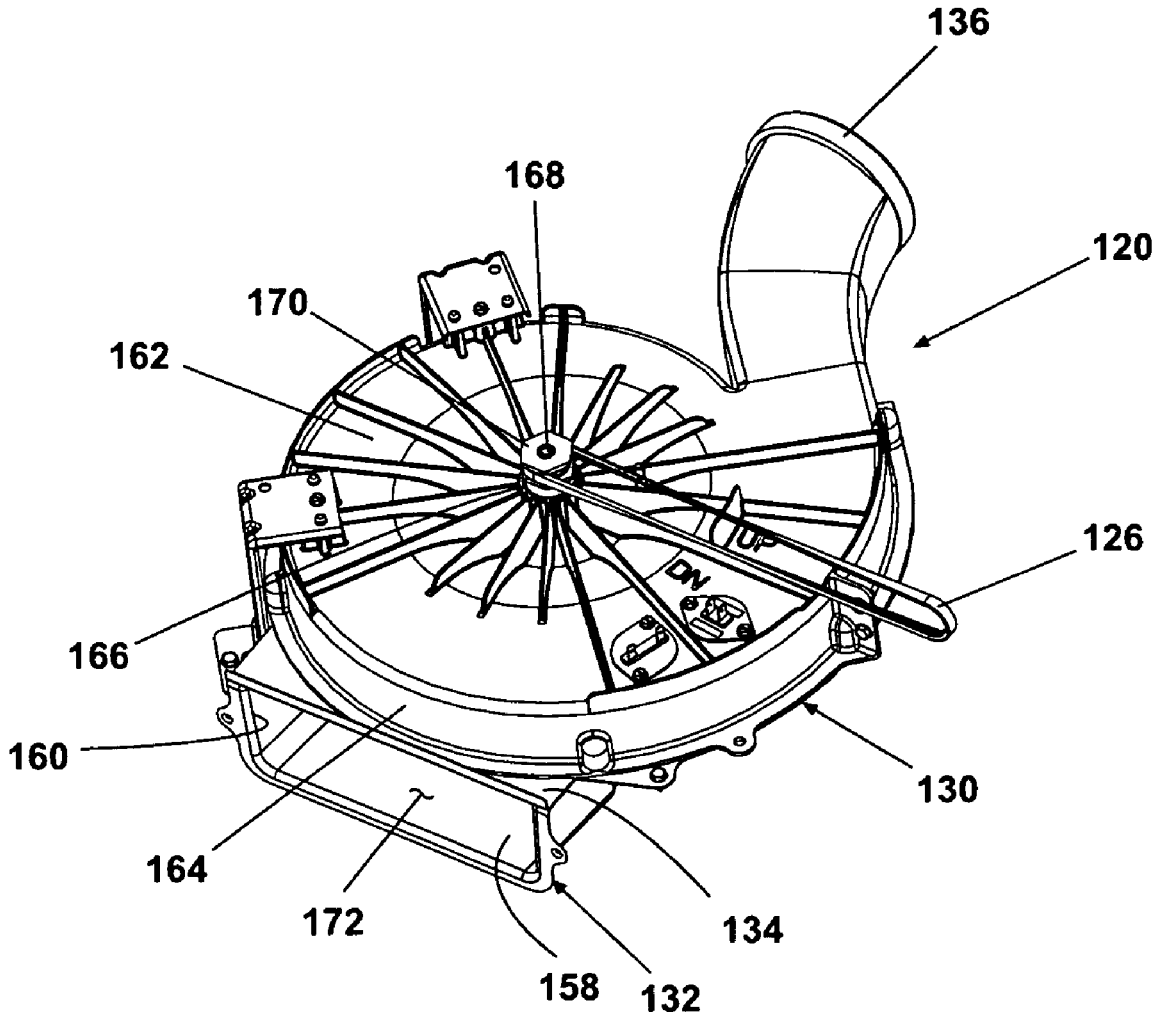
FIG. 6 is a perspective view of the blower assembly illustrated in FIG. 2.
Figure 7:
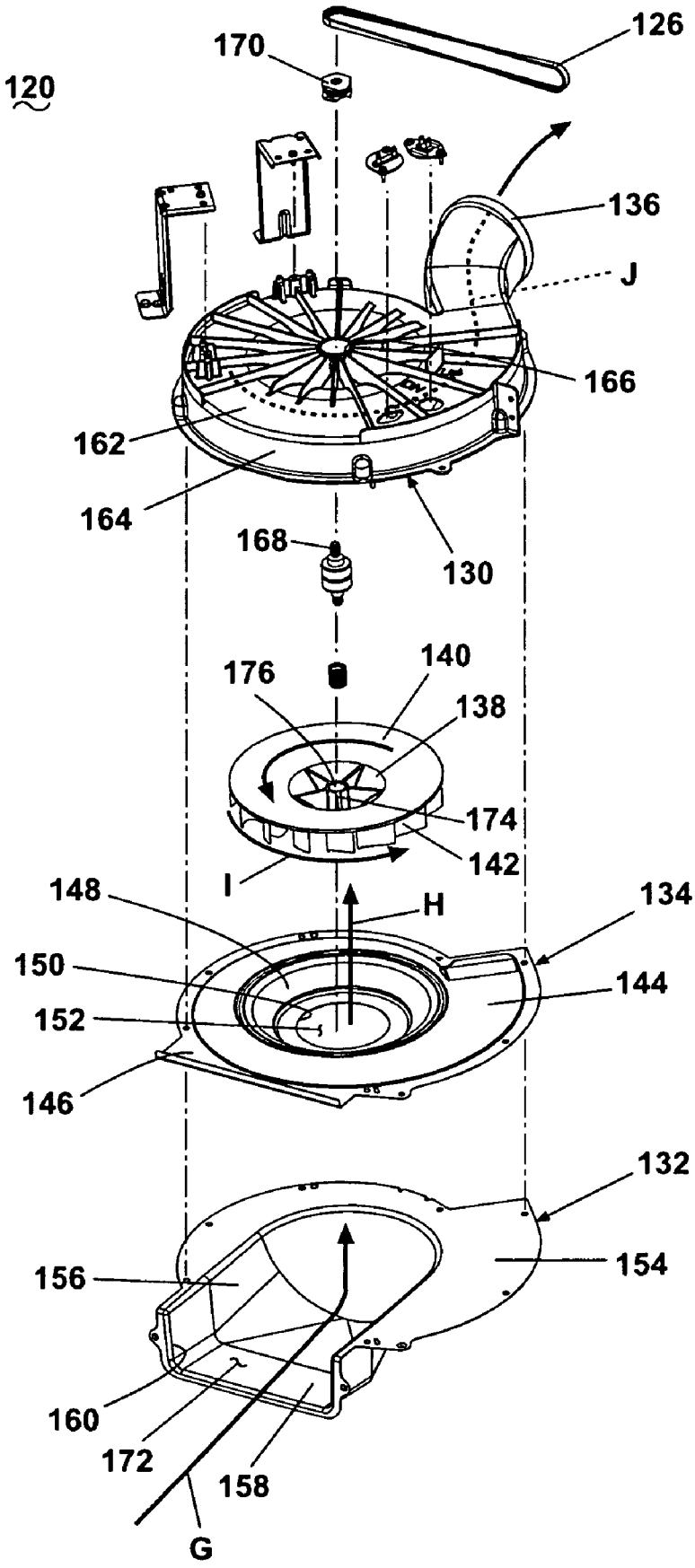
FIG. 7 is an exploded view of the blower assembly illustrated in FIG. 6, illustrating air flow through the blower assembly.
Figure 10:
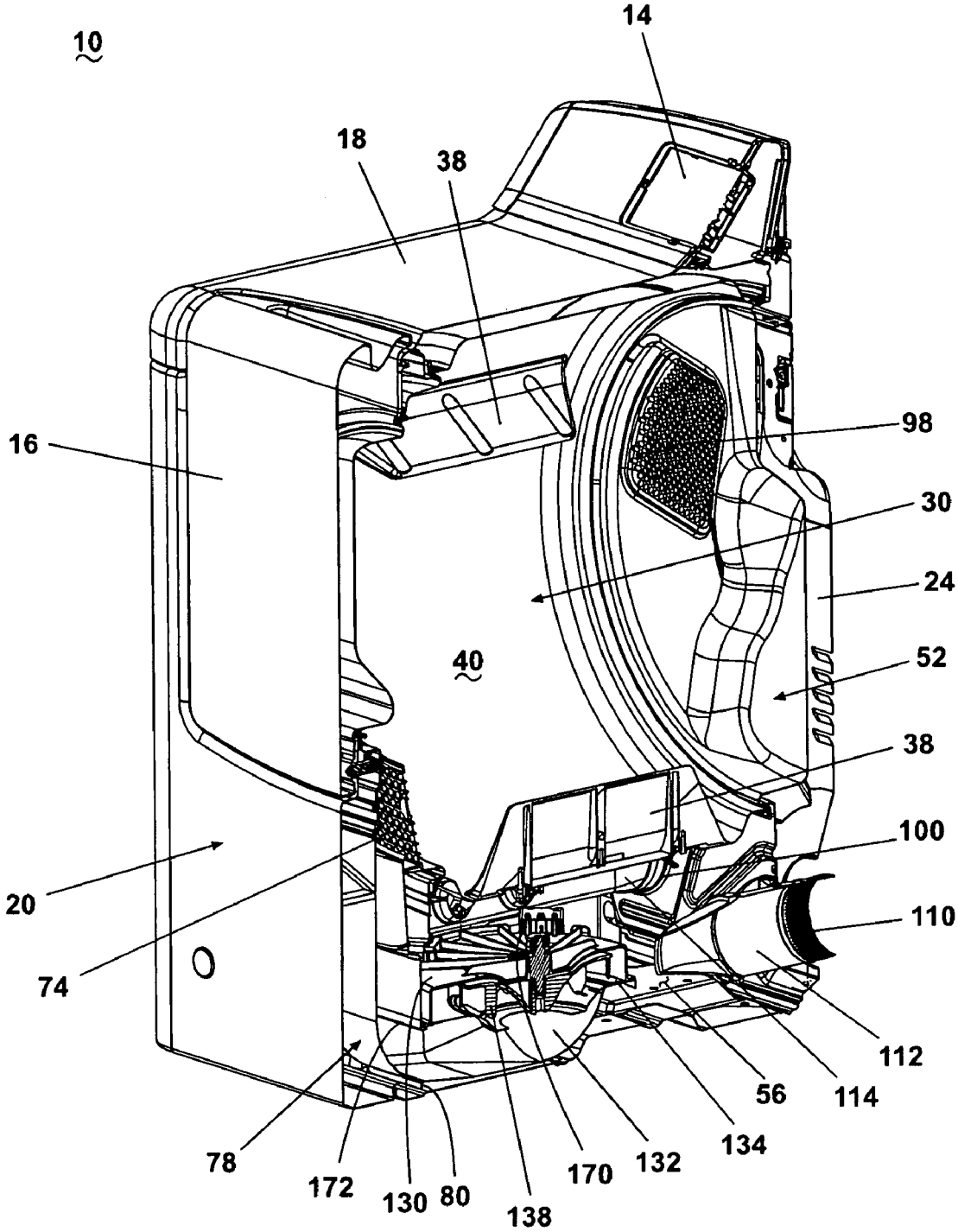
FIG. 10 is a sectional view of the automatic clothes dryer of FIG. 1 taken through view line 10-10.

Referring now to FIGS. 6, 7, and 10, the centrifugal blower assembly 120 comprises a generally well-known rotating impeller enclosed in a housing which is configured to draw in air coaxially and exhaust the air tangentially in a direction orthogonal to the direction of air flow into the impeller. The blower assembly 120 comprises an upper blower housing 130 in air-tight registry with a lower blower housing 132. The upper housing 130 comprises a somewhat helical-shaped shell having a helical wall 162 with a centrally located shaft aperture 166 therethrough. Depending orthogonally from the helical wall 162 along the perimeter thereof is a perimeter wall 164. The helical wall 162 and the perimeter wall 164 transition tangentially into a blower outlet 136.

The lower blower housing 132 comprises an irregularly-shaped shell having a somewhat helical-shaped plate portion 154 adapted for coextensive registry with the upper blower housing 130. Depending orthogonally from the plate portion 154 is an arcuate wall 156 transitioning to a housing floor 158. The arcuate wall 156 and the housing floor 158 extend away from the plate portion 154 to terminate in a rectilinear edge 160.

A guard plate 134 comprising a helical plate 144 is located between the upper blower housing 130 and the lower blower housing 132. A rectilinear flange 146 extends away from the helical plate 144, and is adapted for cooperative registry with the arcuate wall 156 and the rectilinear edge 160 to define a rectilinear blower inlet 172. The center of the helical plate 144 comprises a depending bowl 148 terminating in a coaxial rim 150 defining a coaxial impeller inlet 152 extending therethrough.

The impeller 138 comprises a circular wall portion 140 supporting along a first side a regularly-spaced array of arcuate fins 142. The wall portion 140 can comprise along an opposed second side an annular bearing tube 174 having a coaxial shaft aperture 176 and adapted for fixed registry with a drive shaft 168. The center of the wall portion 140 can also be fabricated with a conical surface extending away from the first side to direct air flowing coaxially into the conical surface radially outwardly along the fins 142.

The blower assembly 120 is assembled with the impeller 138 received in the upper blower housing 130 and the drive shaft 168 extending through the shaft aperture 166 of the upper blower housing 130 into the shaft aperture 176 of the bearing tube 174. The intermediate plate 134 is inserted between the upper blower housing 130 and the lower blower housing 132 to define a first, upper chamber enclosing the impeller 138, and a second, lower chamber defined by the arcuate wall 156 and the housing floor 158. Rotation of the impeller 138 will draw air through the blower inlet 172 into the lower chamber, axially through the impeller inlet 152 into the upper chamber, radially outwardly by the movement of the fins 142, and tangentially out the blower outlet 136.

Figure 9:
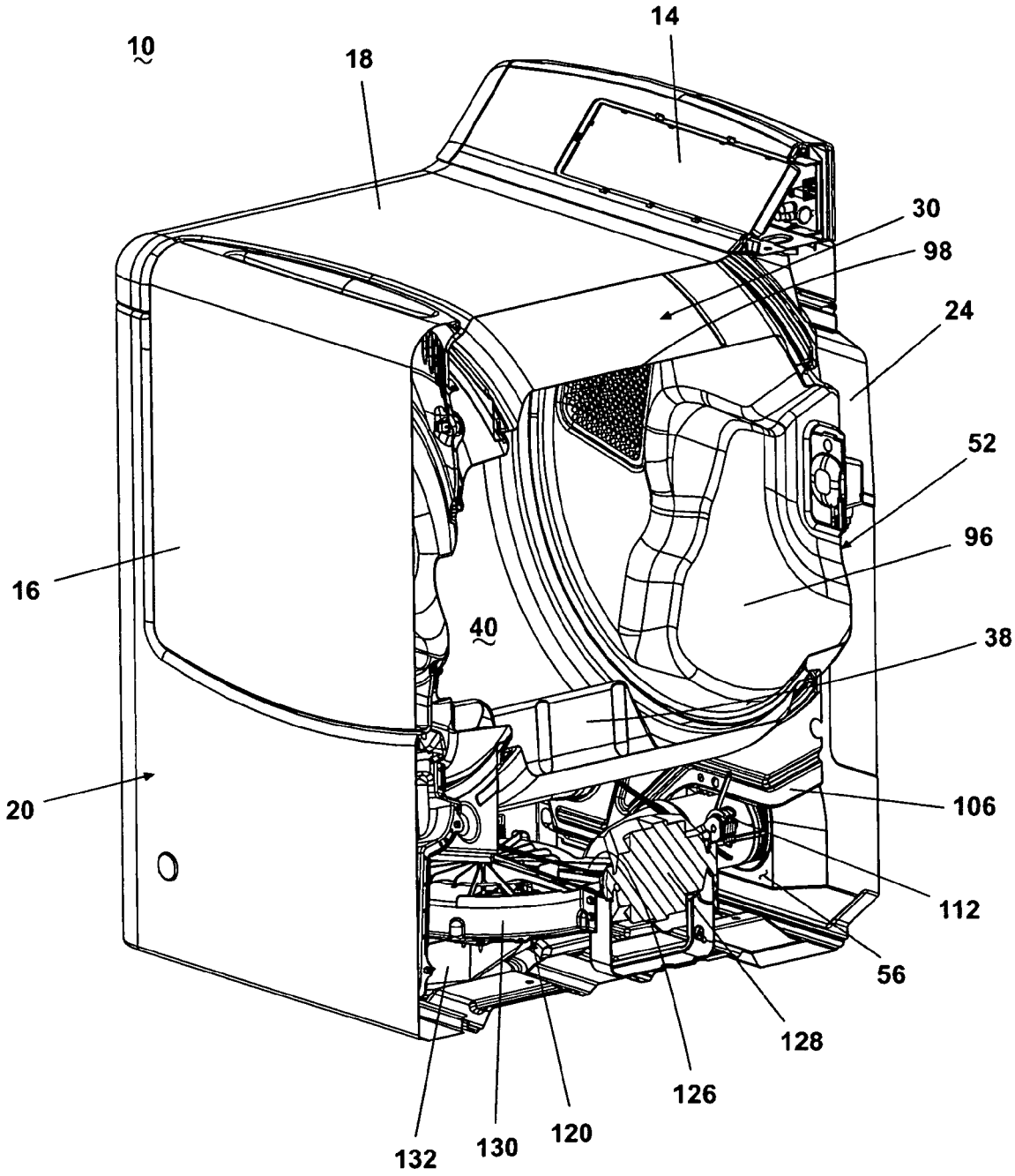
FIG. 9 is a sectional view of the automatic clothes dryer of FIG. 1 taken through view line 9-9.

The drive shaft 168 is provided with a pulley 170 around which the blower drive quarter-turn stretch belt 126 is looped for rotation of the impeller 138 with operation of the motor 128. As illustrated in FIG. 9, the use of a quarter-turn stretch drive belt 126 enables the impeller 138 having a vertical drive shaft 168 to be operated by the motor 128 having a horizontal output shaft.

The separating of the blower assembly 120 from the motor output shaft enables the blower assembly 120 to be placed remotely from the motor 122. The drive shaft 168 can be oriented at an angle relative to the motor output shaft, and the angle can be 90 degrees. The axis of rotation of the drum 30 can be orthogonal to the drive shaft 168, or parallel to the motor output shaft.

Preferably, the blower assembly 120 is mounted to the chassis 22 beneath the drum 30. The motor assembly 122 is preferably mounted to the chassis 22 in the right subspace 56, laterally of the blower assembly 120. In this position, the blower assembly does not interfere with the sizing of the drum. In prior configurations, the blower would have been mounted to the motor, and the radial extent of the blower alone or in combination with the surrounding housing would have been great enough to prevent the maximizing of the drum.

Advantageously, the blower assembly 120 is oriented so that the blower outlet 136 extends toward the rear of the dryer 10. An exhaust air conduit 112 is fixedly attached to the blower outlet 136 to exit the air through an exhaust outlet, or air exhaust port 110 for registry with an external dryer vent hose. The direction of air flow from the blower outlet 136 to the exhaust outlet is constant. Further, the longitudinal axis along the exhaust air conduit 112 varies less than 90 degrees. That is, air flows unidirectionally, e.g. no sharp bends, from the blower outlet 136 through the exhaust air conduit 112 to the air exhaust port 110, thereby minimizing losses due to bends in the exhaust air conduit 112 downstream of the blower assembly 120.

As illustrated in FIG. 8, during operation of the dryer, fresh air is drawn into the inlet air conduit 114, represented by the air flow vector identified as "A." The air can selectively be heated in the inlet air conduit 114, and is then drawn into the vertical air conduit 116, represented by the air flow vector identified as "B." The air travels up the vertical air conduit 116 to enter the drum 30 through the grille 98, represented by the air flow vector identified as "C." The air is then drawn through the grille 74 into the air circulation duct 78, represented by the air flow vector identified as "D," and out the exhaust opening 80 into the blower inlet 172, represented by the air flow vector identified as "E."

Referring to FIG. 7, air represented by the air flow vector "G" travels into the lower blower housing 132 and upwardly through the impeller inlet 152 in the intermediate plate 134, represented by the air flow vector "H." Rotation of the impeller 138, illustrated in FIG. 7 as counterclockwise, draws air radially outwardly to the perimeter of the impeller 138, represented by the air flow vector "I," and along the perimeter of the upper blower housing 130 to exit the blower outlet 136, represented by the air flow vector "J." Referring again to FIG. 8, air exhausted through the blower outlet 136 enters the exhaust air conduit 112 and is exhausted through the air exhaust port 110, represented by the air flow vector identified as "F."

The use of a centrifugal blower oriented to rotate about a vertical axis enables the blower to be mounted in the automatic clothes dryer below the drum 30. The centrifugal blower has a much smaller vertical profile than the prior art blowers alone and in combination with the surrounding air duct housing. As a consequence of not directly mounting the blower to the motor output shaft, the blower assembly can be located remotely of the motor resulting in more space is available for the drum, thereby enabling the size of the drum to be maximized for a given cabinet configuration.

The ability to locate the blower separately from the motor also enables the blower to be mounted in a horizontal orientation for rotation about a vertical axis, instead of a vertical orientation for rotation about a horizontal axis. The change in orientation further aids in the blower assembly being positioned such that the drum diameter can be maximized.

Furthermore, the motor can be remotely located relative to the blower, providing further flexibility in minimizing the space occupied by the blower and motor, and maximizing the space available for the drum. The separation and repositioning of the blower relative to the motor also enables the use of a larger diameter blower, thereby increasing air flow through the drum to accommodate any increased drum size and increased dryer load.

The repositioned blower is further advantageous in that is also be oriented so that the exhaust opening from the blower can be connected in-line with the exhaust opening through the dryer cabinet, thereby eliminating a 90° bend typically required with a conventional, vertically oriented blower. The elimination of one bend greatly reduces the backpressure in the air flow system and improves the air flow rate for a given blower. In fact, it is possible to reduce the blower capacity from a traditional blower, resulting in a cost improvement.

It should be noted that while the blower as illustrated is shown as being driven by a belt connected to the drum motor, the blower could be a self-powered blower having its own motor. Additionally, the blower rotational speed can be selected as desired (either by selection of pulley ratios or by selection of its own blower motor) and is not limited to operating at the same speed as the drum drive motor shaft as is the case where a blower is directly coupled to the drum drive motor shaft.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An automatic clothes dryer, comprising:

a cabinet defining a rectilinear interior space and having an opposing top and bottom and opposing sides extending between the top and bottom to partially define the interior space and to form corners at the junction of the top and bottom with the sides;

a cylindrical drum defining a drying chamber and rotatably mounted within the interior space to define subspaces within the interior space between the corners and the drum;

a drive motor mounted within one of the subspaces and having an output shaft operably coupled to the drum for rotating the drum; and a blower mounted within the interior space out of the subspaces and between the drum and one of the bottom and top, and fluidly coupled to the drying chamber for moving air through the drying chamber, the blower having a drive shaft separate and remote from the output shaft to permit the independent positioning of the blower and drive motor.

2. The automatic clothes dryer according to claim 1, wherein the blower has a blower height and the drive motor has a motor height greater than the blower height, and the mounting of the cylindrical drum within the interior space defines a distance between the cabinet bottom and a nadir of the drum that is greater than the blower height but less than the motor height so that the blower can be mounted beneath the drum when the motor is mounted within the one of the subspaces.

3. The automatic clothes dryer according to claim 2, wherein air flow capacity of the blower can be increased by increasing a lateral dimension of the blower without increasing the distance between the cabinet bottom and the nadir of the drum.

4. The automatic clothes dryer according to claim 1, wherein the blower and drive motor are positioned within the interior space to permit the maximizing of the size of the drum within the interior space.

5. The automatic clothes dryer according to claim 4, wherein the size of the drum is maximized.

6. The automatic clothes dryer according to claim 5, wherein the drum has a diameter and the diameter is maximized.

7. The automatic clothes dryer according to claim 1, wherein the cabinet has a standard dimension.

8. The automatic clothes dryer according to claim 7, wherein the standard dimension is at least one of a standard height and standard width.

9. The automatic clothes dryer according to claim 8, wherein the standard height is no more than 38 inches and the standard width is no more than 29 inches.

10. The automatic clothes dryer according to claim 1, wherein the drive shaft is oriented at an angle relative to the output shaft.

11. The automatic clothes dryer according to claim 10, wherein the angle is 90 degrees.

12. The automatic clothes dryer according to claim 10, wherein the axis of rotation of the drum is orthogonal to the drive shaft.

13. The automatic clothes dryer according to claim 12, wherein the axis of rotation of the drum is parallel to the output shaft.

14. The automatic clothes dryer according to claim 1, wherein the blower is located between the drum and the bottom of the cabinet.

15. The automatic clothes dryer according to claim 1, and further comprising an exhaust outlet fluidly coupled to the blower, wherein the direction of air flow from the blower to the exhaust outlet is constant.

16. The automatic clothes dryer according to claim 1, and further comprising an exhaust outlet fluidly coupled to the blower through a conduit, wherein a longitudinal axis along the conduit varies less than 90 degrees.

17. The automatic clothes dryer according to claim 1, wherein the blower is a centrifugal blower.

18. The automatic clothes dryer according to claim 1, wherein the air flow from the blower to the exhaust vent is unidirectional.

19. An automatic clothes dryer, comprising:

a cabinet defining an interior space;

a drum mounted within the interior space and defining a drying chamber, and rotatable about a drum axis;

a drive motor mounted within the interior space and having an output shaft operably coupled to the drum for rotating the drum; and a blower mounted within the interior space and fluidly coupled to the drying chamber for drawing air through the drying chamber and exhausting the air from the blower, and having a drive shaft rotatable about a blower axis that is separate and orthogonal to the drum axis, and the direction of air flow exhausted from the blower is substantially parallel to the drum axis.

20. The automatic clothes dryer according to claim 19, wherein the blower and drive motor are positioned within the interior space to permit the maximizing of the size of the drum within the interior space.

21. The automatic clothes dryer according to claim 20, wherein the size of the drum is maximized.

22. The automatic clothes dryer according to claim 21, wherein the drum has a diameter and the diameter is maximized.

23. The automatic clothes dryer according to claim 19, wherein the drive shaft is oriented at an angle relative to the output shaft.

24. The automatic clothes dryer according to claim 23, wherein the angle is 90 degrees.

25. The automatic clothes dryer according to claim 19, wherein the axis of rotation of the drum is parallel to the output shaft.

26. The automatic clothes dryer according to claim 19, and further comprising an exhaust outlet fluidly coupled to the blower, wherein the direction of air flow from the blower to the exhaust outlet is constant.

27. The automatic clothes dryer according to claim 19, and further comprising an exhaust outlet fluidly coupled to the blower through a conduit, wherein a longitudinal axis along the conduit varies less than 90 degrees.

28. The automatic clothes dryer according to claim 19, wherein the blower is an axial flow blower.

* * * * *